US009142874B2

(12) United States Patent
Wu et al.

(10) Patent No.: US 9,142,874 B2
(45) Date of Patent: Sep. 22, 2015

(54) WIRELESS DEVICE

(75) Inventors: Min-Chung Wu, Hsinchu County (TW); Shao-Chin Lo, Hsinchu County (TW)

(73) Assignee: MEDIATEK INC., Science-Based Industrial Park, Hsin-Chu (TW)

( * ) Notice: Subject to any disclaimer, the term of this patent is extended or adjusted under 35 U.S.C. 154(b) by 369 days.

(21) Appl. No.: 13/050,918

(22) Filed: Mar. 17, 2011

(65) Prior Publication Data

US 2012/0162042 A1 Jun. 28, 2012

(30) Foreign Application Priority Data

Dec. 28, 2010 (TW) ..... 99146233 A

(51) Int. Cl.
*H01Q 1/38* (2006.01)
*H01Q 1/22* (2006.01)
*H01Q 9/42* (2006.01)

(52) U.S. Cl.
CPC ..... *H01Q 1/2275* (2013.01); *H01Q 9/42* (2013.01)

(58) Field of Classification Search
USPC ..... 343/702, 906, 722, 850, 860
See application file for complete search history.

(56) References Cited

U.S. PATENT DOCUMENTS

| | | | | |
|---|---|---|---|---|
| 7,207,059 | B1 * | 4/2007 | Kurian et al. | 726/9 |
| 2007/0270038 | A1 * | 11/2007 | Liu et al. | 439/630 |
| 2009/0167631 | A1 * | 7/2009 | Tai et al. | 343/906 |
| 2009/0251373 | A1 * | 10/2009 | Degner et al. | 343/702 |
| 2011/0156963 | A1 * | 6/2011 | Rajgopal et al. | 343/702 |
| 2011/0230147 | A1 * | 9/2011 | Schuh et al. | 455/90.2 |
| 2012/0264382 | A1 * | 10/2012 | Lockerbie | 455/90.2 |

FOREIGN PATENT DOCUMENTS

TW I238595 8/2005

* cited by examiner

*Primary Examiner* — Sujoy Kundu
*Assistant Examiner* — Steven J Malone
(74) *Attorney, Agent, or Firm* — Winston Hsu; Scott Margo

(57) ABSTRACT

The present invention discloses a wireless device. The wireless device includes a housing, formed by a metal material, a wireless module disposed inside the housing, and an antenna, disposed outside the housing, coupled to the wireless module via a external socket interface disposed on the housing, for transmitting and receiving signals corresponding to the wireless module.

12 Claims, 6 Drawing Sheets

WIRELESS DEVICE

BACKGROUND OF THE INVENTION

1. Field of the Invention

The present invention relates to a wireless device, and more particularly, to a wireless device capable of transmitting and receiving signals corresponding to a built-in wireless module via an externally coupled antenna to reduce shielding effect.

2. Description of the Prior Art

Current trends in consumer electronics demand more elegant and stylish product appearances in addition to functional requirements, resulting in a rising usage of aluminum alloy housings for consumer electronic products (e.g. MP3 players, cell phones, tablet and notebook computers). However, while adding a sense of elegance and stylishness to products, such aluminum alloy housings can cause signal transmission and reception problems for antennas inside the product.

For instance, please refer to FIG. 1A, which is a schematic diagram of a conventional notebook computer 10. To implement wireless communication functionalities, the notebook computer 10 includes an antenna 102, for transmitting and receiving wireless signals corresponding to a built-in wireless module. Generally, for suitable protection, the antenna 102 is disposed inside a housing 100 of the notebook computer 10. As a result, the material used for the housing 100 can greatly affect radiation efficiency of the antenna 102. For example, please refer to FIG. 1B and FIG. 1C, which are schematic diagrams of the antenna 102 transmitting and receiving wireless signals when non-metallic and metallic materials are used for the housing 100, respectively. As shown in FIG. 1B, when the housing 100 is formed by a non-metallic material, the wireless signals can penetrate the housing 100 without shielding effect, allowing normal wireless communication. However, as shown in FIG. 1C, when the housing 100 is formed by a metallic material (e.g. aluminum alloy or other materials that generate shielding effect), the wireless signals from the antenna 102 cannot penetrate the metal housing due to metal shielding effect, causing a faulty wireless transmission. Solutions employing external wireless modules for the shielding effect suffer from an excessive increased volume. Hence, it is necessary to improve upon prior art techniques.

SUMMARY OF THE INVENTION

Therefore, the primary objective of the present invention is to provide a wireless device.

The present invention discloses a wireless device. The wireless device comprises a housing, formed by a metal material; a wireless module, disposed inside the housing; and an antenna, disposed outside the housing, coupled to the wireless module via an external socket interface disposed on the housing, for transmitting and receiving signals corresponding to the wireless module.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
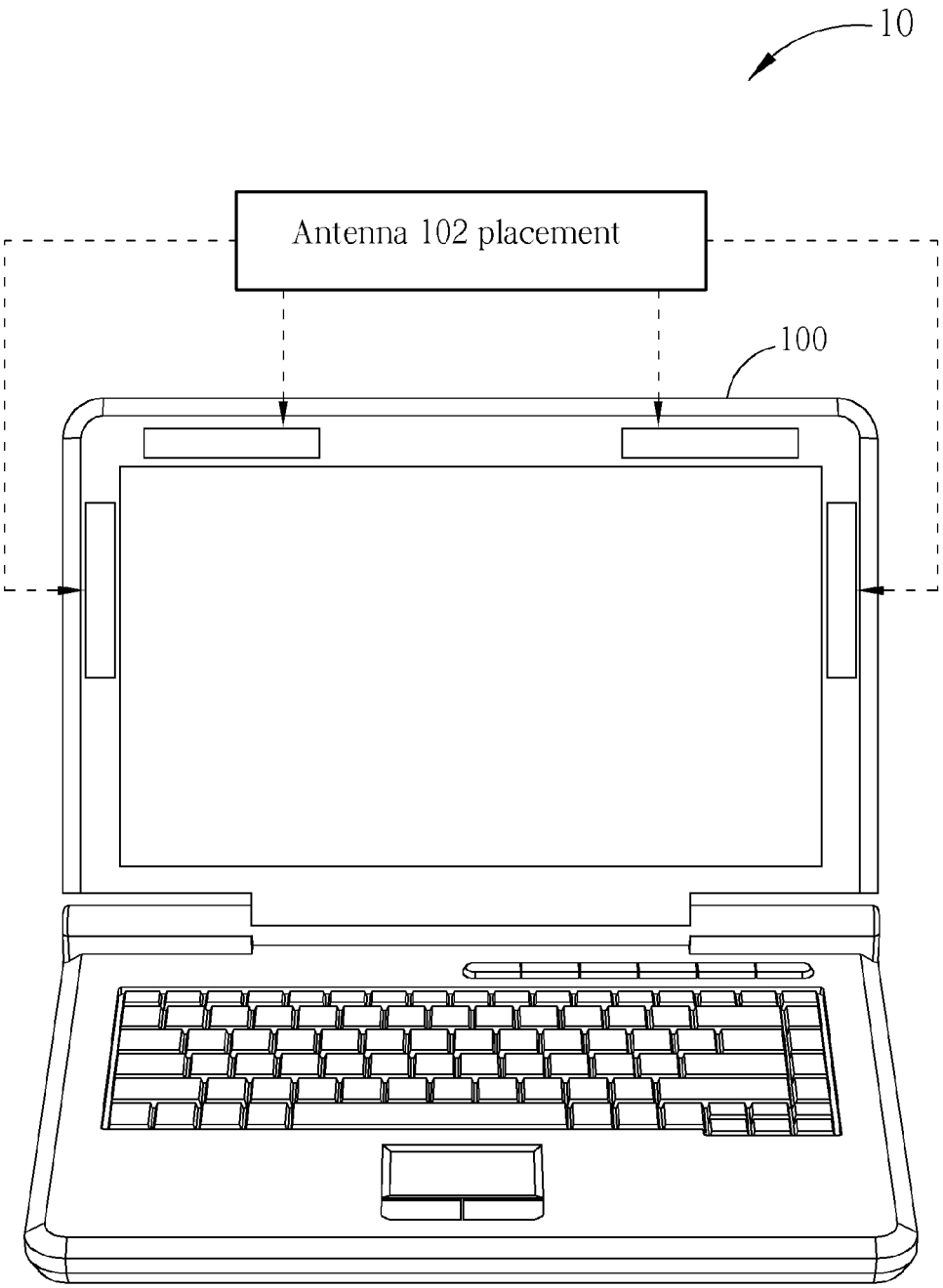
FIG. 1A is a schematic diagram of a conventional notebook computer.
Figure 1C:
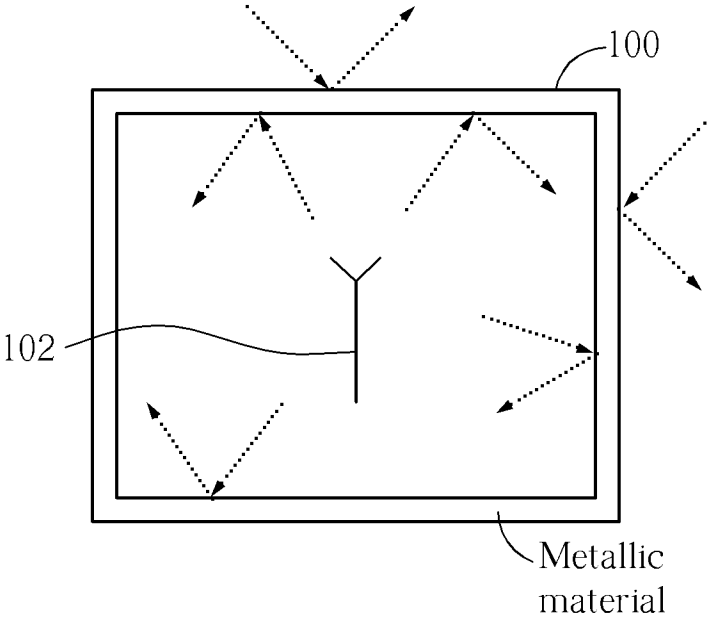
FIG. 1B and FIG. 1C are schematic diagrams of an antenna transmitting and receiving wireless signals when non-metallic and metallic materials are used for the housing in FIG. 1A, respectively.
Figure 1B:
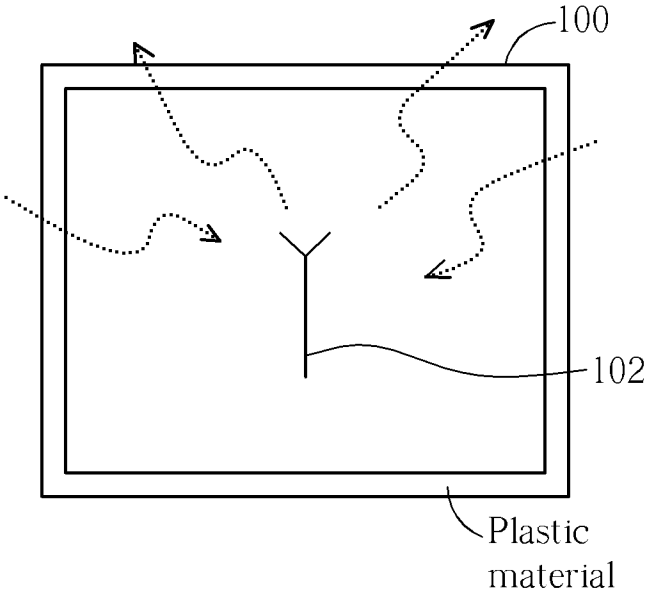
Figure 2:
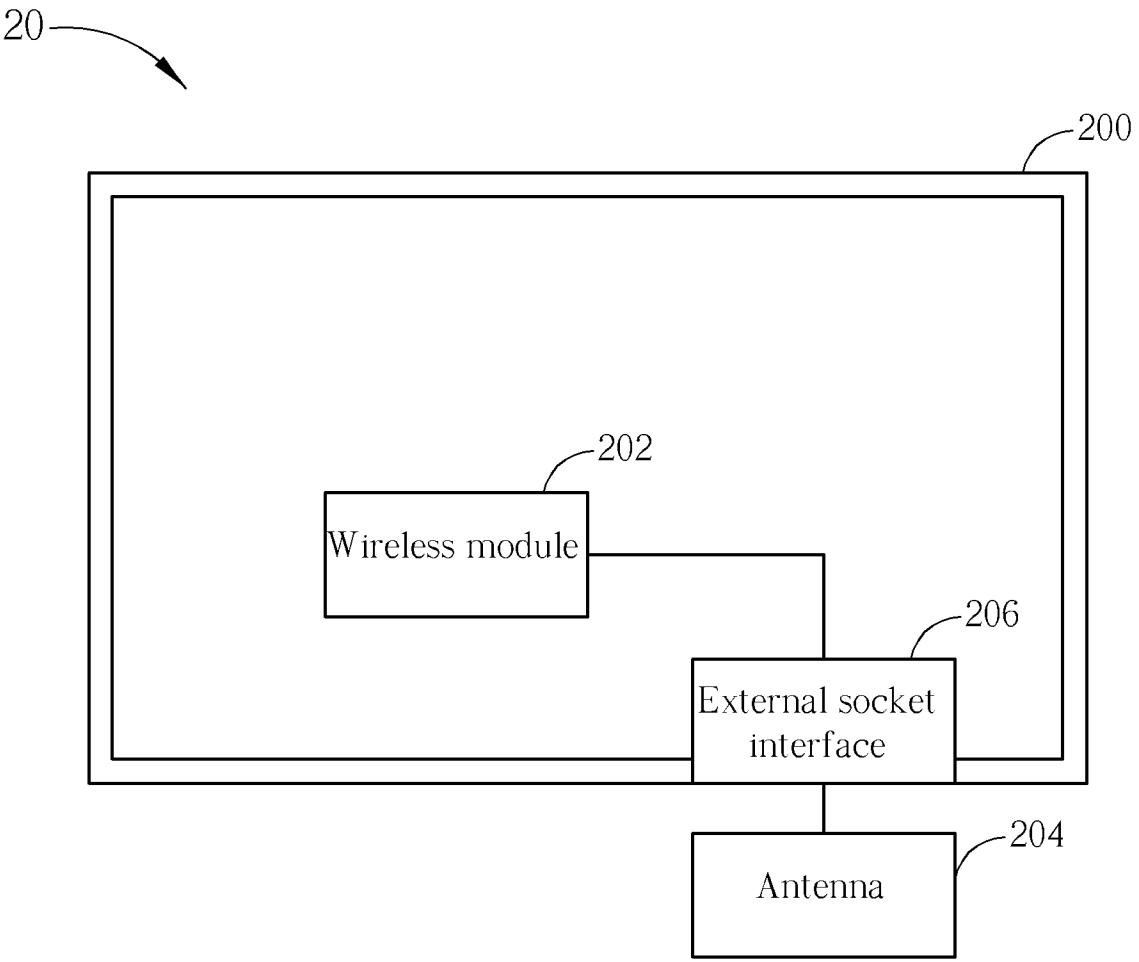
FIG. 2 is a schematic diagram of a wireless device according to an embodiment of the present invention.

As shown in FIG. 2, FIG. 2 is a schematic diagram of a wireless device 20 according to an embodiment of the present invention. The wireless device 20 includes a housing 200, a wireless module 202 and an antenna 204. The housing 200 is formed by a metal material, and encases the wireless module 202. In other words, the housing 200 can cause shielding effect on signals of the wireless module 202. An external socket interface 206 is disposed on the housing 200. The wireless module 202 is built into the wireless device 20, i.e. disposed inside the housing 200. The antenna 204 is disposed outside the housing 200, coupled to the wireless module 202 via the external socket interface 206, and is capable of transmitting and receiving the signals corresponding to the wireless module 202. Consequently, despite that the housing 200 is formed by a metal material, the wireless module 202 is still capable of utilizing the antenna 204 outside the housing 200 to transmit and receive signals via the external socket interface 206, unaffected by the shielding effect generated by the housing 200. In this way, the wireless device 20 can achieve normal transmission and reception of the signals corresponding to the wireless module 202 at the cost of only a fractional increment in external volume, while employing a stylish metallic housing.

Figure 3A:
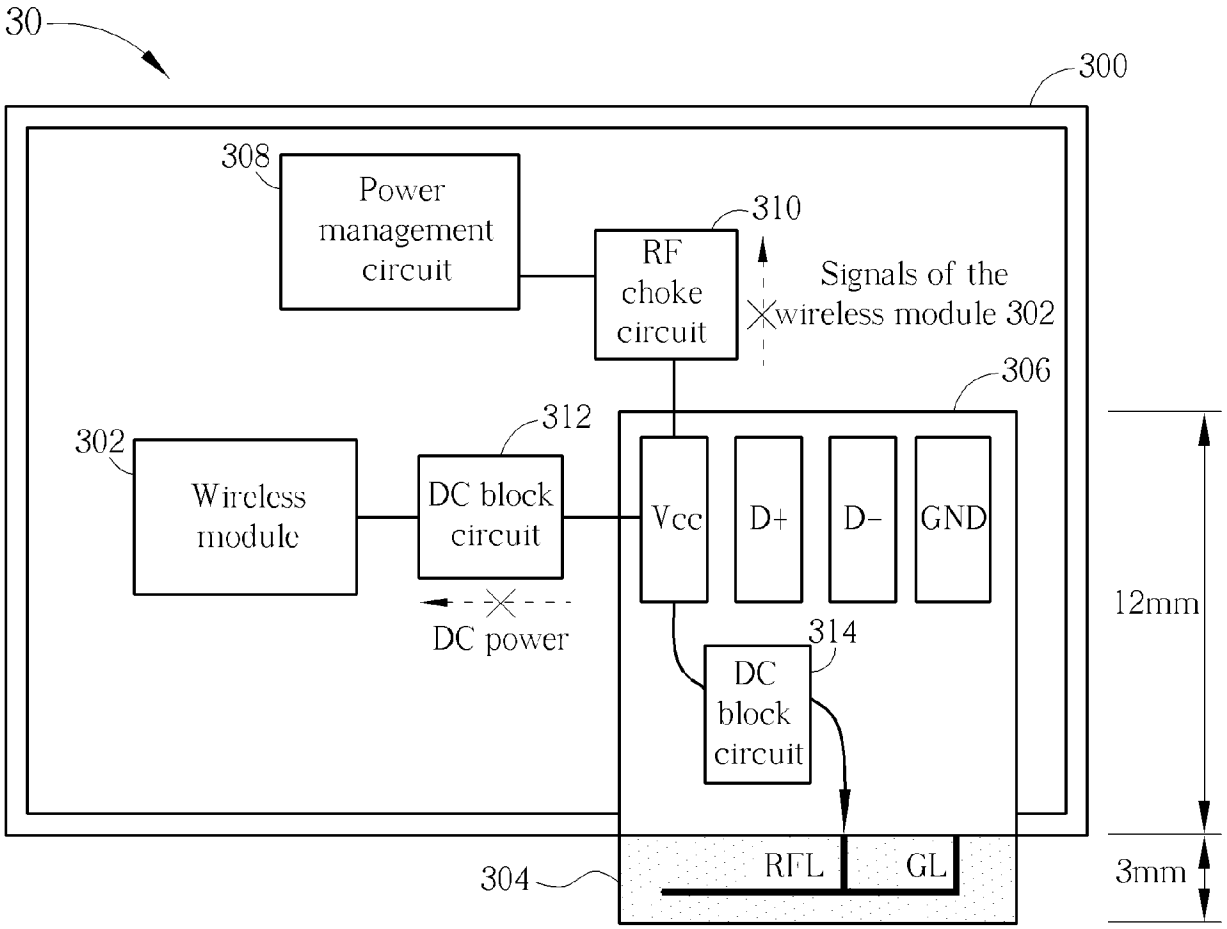
FIG. 3A and FIG. 3B are schematic diagrams of a notebook computer according to an embodiment of the present invention.
Figure 3B:
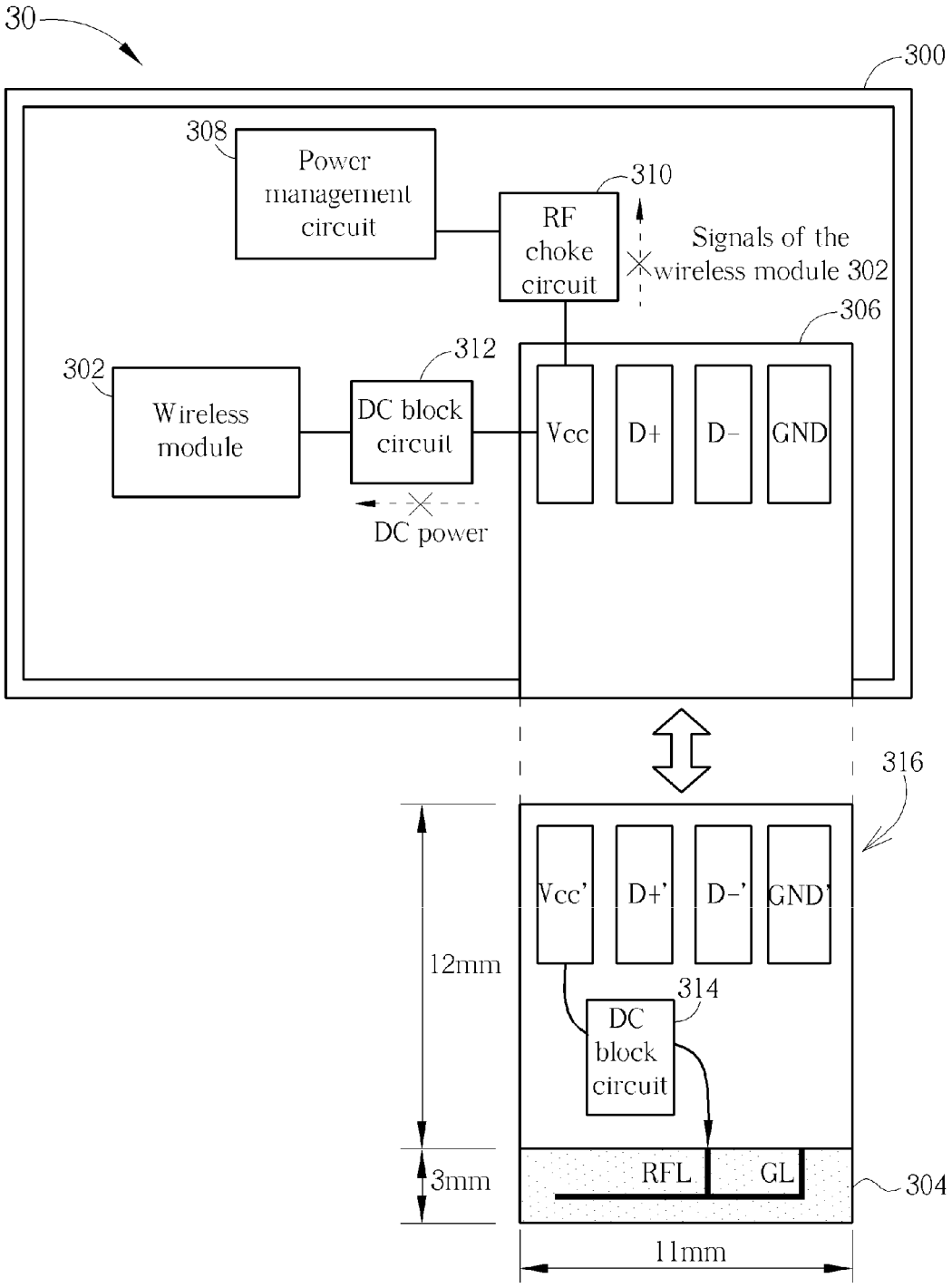

For example, please refer to FIG. 3A and FIG. 3B, which are schematic diagrams of a notebook computer 30 according to an embodiment of the present invention. The notebook computer 30 has a structure similar to that of the wireless device 20, and comprises a housing 300, a wireless module 302 and an antenna 304. The main distinction between the notebook computer 30 and the wireless device 20 is that, the notebook computer 30 utilizes a Universal Serial Bus (USB) port 306 to realize the external socket interface 206 in FIG. 2. The USB port 306 comprises a power supply pin Vcc, data transmission pins D+, D− and a ground pin GND; therefore, to operate accordingly, the notebook computer 30 further includes a power management circuit 308, and the antenna 304 further includes a ground GL and a signal trace RFL.

Generally, the power management circuit 308 can utilize the power supply pin Vcc to provide a DC power supply (e.g. 5 V) to an external Universal Serial Bus module (e.g. flash memory module, Bluetooth module, Wi-Fi module, hard drive data transmission), the data transmission pins D+, D− can be utilized to transmit data, and the ground pin GND can be connected to a common ground between a motherboard and a system module. In an embodiment of the present invention, the USB port 306 can further be utilized as an interface for coupling the built-in wireless module 302 to the external antenna 304, such that the built-in wireless module 302 can utilize the antenna 304 disposed outside the housing 300 to transmit and receive the signals, unaffected by shielding effect.

Specifically, as shown in FIG. 3B, the antenna 304 is disposed on a Universal Serial Bus (USB) module 316 and coupled to the USB port 306 in a pluggable manner. The USB module 316 comprises a power supply pin Vcc', data transmission pins D+', D−' and a ground pin GND', corresponding to the power supply pin Vcc, the data transmission pins D+, D− and the ground pin GND of the USB port 306, respectively. As shown in FIG. 3A, when the antenna 304 is coupled to the USB port 306, the signal trace RFL is coupled to the power supply pin Vcc of the USB port 306, and the ground GL is coupled to the ground pin GND of the USB port 306. Since a depth of the USB port 306 conforms to a predefined standard (12 mm), dimensions of the USB module 316 and position of the antenna 304 may be designed accordingly such that the antenna 304 is disposed outside the housing 300 (by approximately 3 mm). As a result, the wireless module 302 is capable of utilizing the antenna 304 disposed outside the housing 300 to transmit and receive signals via coupling to the power supply pin Vcc of the USB port 306, at a cost of only a small increase in external volume, and thus the wireless module 302 is unaffected by shielding effect while maintaining a stylish metallic housing of the notebook computer 30.

Moreover, since the power supply pin Vcc is generally utilized by the power management circuit 308 for providing DC power supply, and also further utilized for signal transmission of the wireless module 302 according to the embodiment of the present invention, to prevent signal interference between the DC power supply and the signals of the wireless module 302 due to the common power supply pin Vcc, the notebook computer 30 can further include a RF choke circuit 310 and a DC block circuit 312. The RF choke circuit 310 is coupled between the power supply pin Vcc and the power management circuit 308, for inhibiting the signals corresponding to the wireless module 302 from entering the power management circuit 308 via the power supply pin Vcc. The RF choke circuit 310 can be implemented by an inductor or a low-pass filter capable of filtering out high frequency signals. The DC block circuit 312 is coupled between the power supply pin Vcc and the wireless module 302, for inhibiting the DC power provided by the power management circuit 308 from entering the wireless module 302 via the power supply pin Vcc. The DC block circuit 312 can be implemented by a capacitor or a high-pass filter capable of filtering out low frequency signals. In this way, the signals of the wireless module 302 do not enter the power management circuit 308; conversely, the DC power from the power management module 308 does not enter the wireless module 302, thus providing good isolation.

On the other hand, to prevent the DC power provided by the power management circuit 308 from being grounded to the ground pin GND via the antenna 304, another DC block circuit 314 can be coupled between the signal trace RFL and the power supply pin Vcc, to prevent short circuit when the DC power provided by the power management module 308 is directly connected to the ground. Note that, the DC block circuit 314 is unnecessary if the antenna 304 is a monopole antenna or any other kind of antenna without the ground GL, since the DC power provided by the power management circuit 308 is not connected to the ground via the antenna 304.

It is worth noting that, the spirit of the present invention is that the built-in wireless module 202 can utilize the antenna 204 disposed outside the housing 200 to transmit and receive signals via the external socket interface 206, unaffected by shielding effect of the housing 200. Those skilled in the art should make modifications or alterations accordingly and are not limited thereto. For instance, the wireless device 20 is preferred to be a notebook computer, but it may also be an MP3 player, cell phone or any other device requiring signal transmission and reception via the wireless module 202 and the antenna 204; the metallic material forming the housing 200 may be aluminum alloy or any other metallic material that generates shielding effect; the external socket interface 206 is preferably a Universal Serial Bus port, but may also be a Line Print Terminal (LPT) or RS-232 or any other interface capable of signal transmission; and the wireless module 202 may also be a Bluetooth module, a Wi-Fi module, a Third Generation (3G) mobile communication module or a Global Positioning System (GPS) module.

Figure 4:
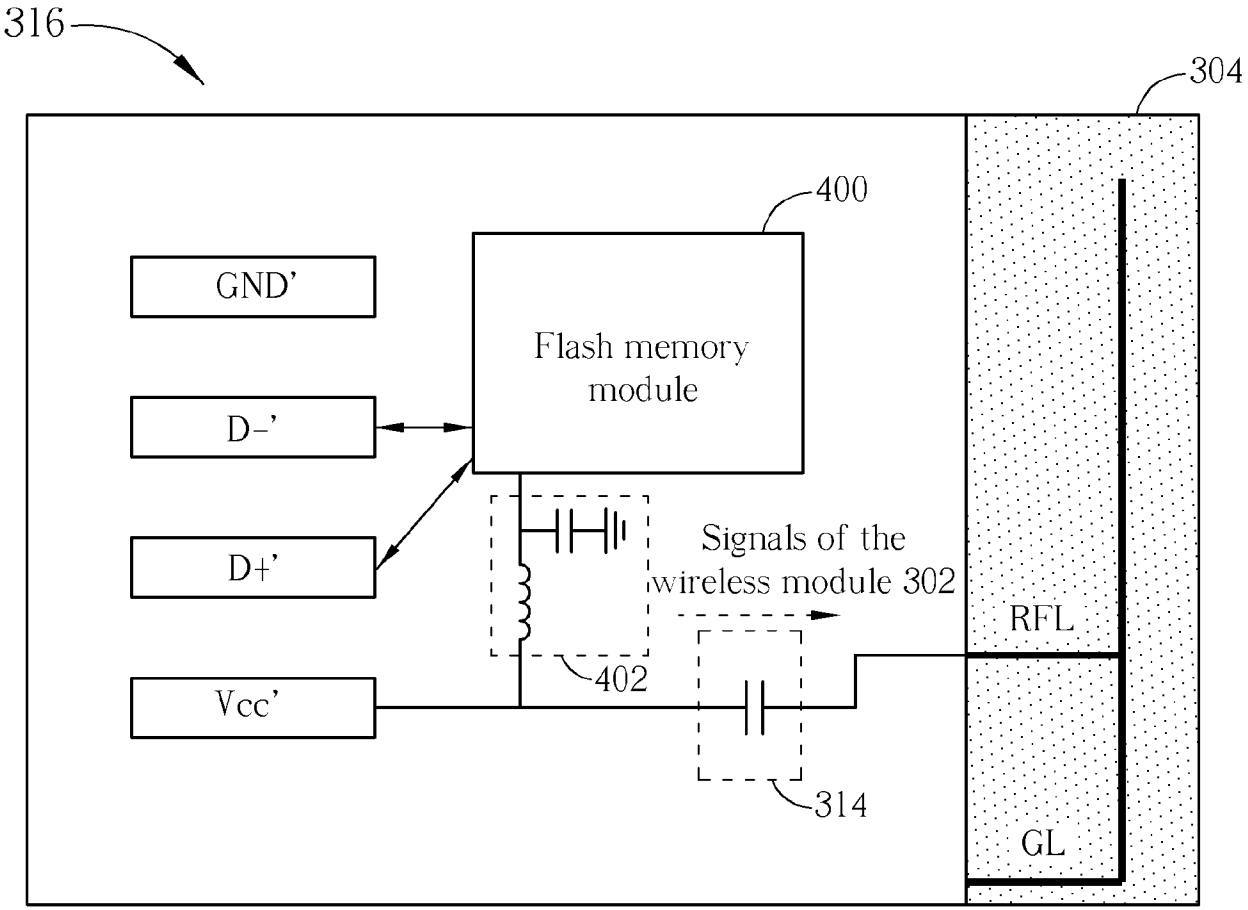
FIG. 4 is a schematic diagram of the Universal Serial Bus (USB) module in FIG. 3.

Furthermore, in the embodiment of the present invention, no additional external socket interface 206 dedicated to the antenna 204 has been implemented, instead, suitable modifications are made to the existing external socket interface 206 of the wireless device 20, such that the wireless module 202 can utilize the antenna 204 disposed outside the housing 200 to transmit and receive signals via the external socket interface 206, without incurring extra costs while retaining existing functionalities of the external socket interface 206. For example, the antenna 304 is disposed on the USB module 316 and coupled to the USB port 306 in a pluggable manner, such that the USB module 316 may be removed from the USB port 306 when the antenna 304 is not needed for transmitting and receiving the signals corresponding to the wireless module 302, thus freeing the USB port 306 for coupling to other external USB modules to operate according to their respective functionalities. Moreover, please refer to FIG. 4, which is a schematic diagram of the USB module 316 in FIG. 3. As shown in FIG. 4, the USB module 316 can further include a flash memory module 400, which receives DC power via the power supply pin Vcc and transmit data via the data transmission pins D+, D−. The flash memory module 400 requires an RF choke circuit 402 to be coupled between the power supply pin Vcc and the signal trace RFL, for inhibiting the signals of the wireless module 302 from entering the flash memory module 400. The flash memory module 400 may also be any other kind of USB module, as long as suitable modifications or alterations are made according to the functionality. As can be seen from the above, the external socket interface 206 not only allows the wireless module 202 to utilize the antenna 204 disposed outside the housing 200 to transmit and receive signals, existing functionalities of the external socket interface 206 are retained, thus no extra costs are incurred.

Traditionally, when the housing of wireless devices is formed by metallic materials, because the built-in wireless module and its corresponding antenna are all disposed inside the housing and the metal housing of the wireless device generates shielding effect, the wireless signals of the antenna 102 cannot penetrate the metal housing, causing failure in wireless functionalities. Solutions employing external wireless module to solve the shielding effect suffer from the excessive increased volume of the external module. Comparatively, in an embodiment of the present invention, with the housing 200 of the wireless device 20 formed by a metal material, the wireless module 202 can utilize the antenna 204 disposed outside the housing 200 to transmit and receive signals via the existing external socket interface 206. Since the antenna 204 is considerably small in volume (approximately 3 mm), the wireless device 20 is capable of performing normal signal transmission and reception at the cost of only a small increase in external volume, while retaining a stylish metallic housing. Moreover, no extra cost is incurred since the external socket interface 206 can retain its existing functionalities.

In summary, the present invention allows wireless devices to achieve normal wireless module signal transmission and reception with no extra cost other than a small increase in external volume, while retaining the usage of a stylish metallic housing.

Those skilled in the art will readily observe that numerous modifications and alterations of the device and method may be made while retaining the teachings of the invention.

What is claimed is:

1. A wireless device, comprising:

a housing, formed by a metal material;

a wireless module, disposed inside the housing;

an external socket interface, disposed on the housing; and an antenna, disposed outside the housing, coupled to the external socket interface for transmitting and receiving signals corresponding to the wireless module; wherein the external socket interface is a USB (Universal Serial Bus) port, and a power supply pin Vcc of the USB port is electrically connected to a signal trace of the antenna, and the power supply pin Vcc of the USB port is physically connected to the wireless module, and the USB port is coupled to a flash memory module which is powered by the power supply pin Vcc via a first RF choke circuit.

2. The wireless device of claim 1, wherein the metal material is an aluminum alloy.

3. The wireless device of claim 1, wherein the metal material generates a shielding effect on the signals of the wireless module.

4. The wireless device of claim 1, wherein the wireless module is a Bluetooth module, a Wi-Fi module, a 3G (Third Generation) mobile communication module or a GPS (Global Positioning System) module.

5. The wireless device of claim 1, wherein the antenna is coupled to the wireless module via the external socket interface in a pluggable manner.

6. The wireless device of claim 1, wherein the wireless device further comprises:

a second RF choke circuit, coupled between the power supply pin and a power management circuit of the wireless device, for inhibiting the signals of the wireless module from entering the power management circuit via the power supply pin; and a second DC block circuit, coupled between the power supply pin and the wireless module, for inhibiting a DC power supplied by the power management circuit from entering the wireless module via the power supply pin.

7. The wireless device of claim 1, wherein a first DC block circuit is disposed in the antenna, coupled between the signal trace and the power supply pin, for inhibiting a DC power supplied by a power management circuit of the wireless device from entering a ground pin of the antenna.

8. The wireless device of claim 1, wherein first RF choke circuit, is utilized for inhibiting the RF signals of the wireless module from entering the flash memory module.

9. The wireless device of claim 6, wherein the second RF choke circuit is a low-pass filter.

10. The wireless device of claim 6, wherein the second RF choke circuit is an inductor.

11. The wireless device of claim 6, wherein the second DC block circuit is a high-pass filter.

12. The wireless device of claim 6, wherein the second DC block circuit is a capacitor.

* * * * *